United States Patent [19]

Cappellina

[11] Patent Number: 4,614,214

[45] Date of Patent: Sep. 30, 1986

[54] TELESCOPIC TAP FOR THE TANKS OF AUTOMATIC LIQUID-FILLING MACHINES

[75] Inventor: Giuseppe Cappellina, San Bonifacio, Italy

[73] Assignee: Ruaro S.p.A., Vicenza, Italy

[21] Appl. No.: 714,202

[22] Filed: Mar. 21, 1985

[51] Int. Cl.[4] ..... B65B 3/04

[52] U.S. Cl. ..... 141/288

[58] Field of Search ..... 141/148, 266, 288, 152, 141/367, 368; 285/33

[56] References Cited

U.S. PATENT DOCUMENTS

| | | | |
|---|---|---|---|
| 2,476,172 | 7/1949 | Williams | 285/33 X |
| 2,591,071 | 4/1952 | Huggins et al. | 141/288 X |
| 2,771,915 | 11/1956 | Harkey, Jr. et al. | 141/288 X |
| 2,897,855 | 8/1959 | Vadas | 141/288 X |
| 3,589,414 | 6/1971 | Risser | 141/288 X |

*Primary Examiner*—Stephen Marcus
*Assistant Examiner*—Mark Thronson
*Attorney, Agent, or Firm*—Birch, Stewart, Kolasch & Birch

[57] ABSTRACT

A tap for the tanks of automatic liquid-filling machines includes a cylindrical cursor housed in a cylindrical sleeve located on the bottom of the tank. A tube is inserted in the lower part of the cursor, and a central shaft extends therethrough to openings for the air exhaust. The cylindrical cursor can slide vertically and is blocked in different positions as defined by impressions present on the cylindrical surface of the cursor which receive a blocking pin. With this adjustment the placing of the tap on containers of different heights is facilitated without it being necessary to vary the distance between the tank and the containers to be filled.

7 Claims, 4 Drawing Figures

TELESCOPIC TAP FOR THE TANKS OF AUTOMATIC LIQUID-FILLING MACHINES

BACKGROUND OF THE INVENTION

The present invention relates to a tap which is adjustable in relation to the tanks of filling machines having a medium or small capacity and being of the automatic type and suitable to fill bottles, jars or cans with liquids of various density, such as foodstuff for instance.

The industrial-type filling machines usually include a tank which is normally cylindrical and contains the liquid to be transferred into the containers; said tank is equipped with a series of taps arranged around the cylinder and under each one of the them are arranged the containers to be filled, which are conveyed to the tank by a conveyor belt and are arranged on a turning platform having a vertical movement which brings the containers in touch with the taps.

The known taps used in the above-mentioned tanks are of the fixed type in relation to the tank and they consist essentially of a pipe in which another pipe, having a smaller diameter and ending with a shaped cap, is axially inserted; the liquid passes from the tank into the cylindrical chamber formed by the inside wall of the external pipe and the outside wall of the smaller pipe being inserted inside, while the air being present in the container exits through the internal pipe and this happens either because of the atmospheric pressure or because of suction in the installations with a high hourly performmance.

The contact between the terminal part of the tap and the container causes the opening of the tap due to the upward sliding of the external part of the tap. While the excursion of the platform which carries the containers to be filled is usually fixed and is only sufficient to insert the terminal part of the containers in the taps, the tank equipped with the taps having a fixed protrusion must be brought to the right level with reference to the height of the containers which are being filled. For this reason it is necessary that the tank be equipped with a mechanical device suitable for the lifting and the lowering.

In the filling machines having a medium or small capacity, the need to lift or to lower the tank involves remarkable complication in the construction which is reflected in a noticeable increase in the cost of the machine. Besides, in the case of filling machines having an atmospheric pressure tank with fixed taps, since the filling speed depends on the level difference between the free space resulting from the upper surface in the tank and the level of the container, such speed remains constant because the level in the tank is usually kept constant. It follows that in the atmospheric pressure tanks having fixed taps, the filling speed cannot, therefore, be increased.

SUMMARY OF THE INVENTION

Therefore, it is an object of the present invention to overcome the above-mentioned inconveniences. In fact, the present invention solves the above listed problems by realizing a telescopic tap, that is a tap, the length of which can be increased or decreased, so as to vary its distance from the bottom of the tank.

According to the invention, the tap is formed by a cylindrical cursor sliding on a sleeve, which is also cylindrical and vertically fixed to the tank. Said cursor holds inside a perforated shaft, being also cylindrical and coaxial, which has the function of expelling the air and is characterized by the fact that it can slide axially in the vertical direction and it can be blocked in pre-set positions, having on its external surface a series of housings into which a pin is inserted which holds the cursor in the chosen position.

One of the advantages obtained with the present invention consists in the fact that the taps of the tank are easily and quickly adjusted to the different heights of the containers, without making it necessary to have a movement of the tank in both vertical directions, which remarkably simplifies the construction of the filling machine.

Another advantage consists in the fact that, when the cursor of the tap has its maximum protrusion from the tank, the level difference between the upper surface in the tank and the container to be filled increases with a subsequent increase of the speed with which the liquid exits and a decrease of the filling time.

BRIEF DESCRIPTION OF THE DRAWINGS

Other characteristics and construction details will be better understood in the description of a preferred form of execution of the tap being the object of the present invention, which is given by way of example only, and is not meant to limit the scope of the present invention, and wherein.

DETAILED DESCRIPTION OF THE DRAWINGS

Figures 1, 2, 3:
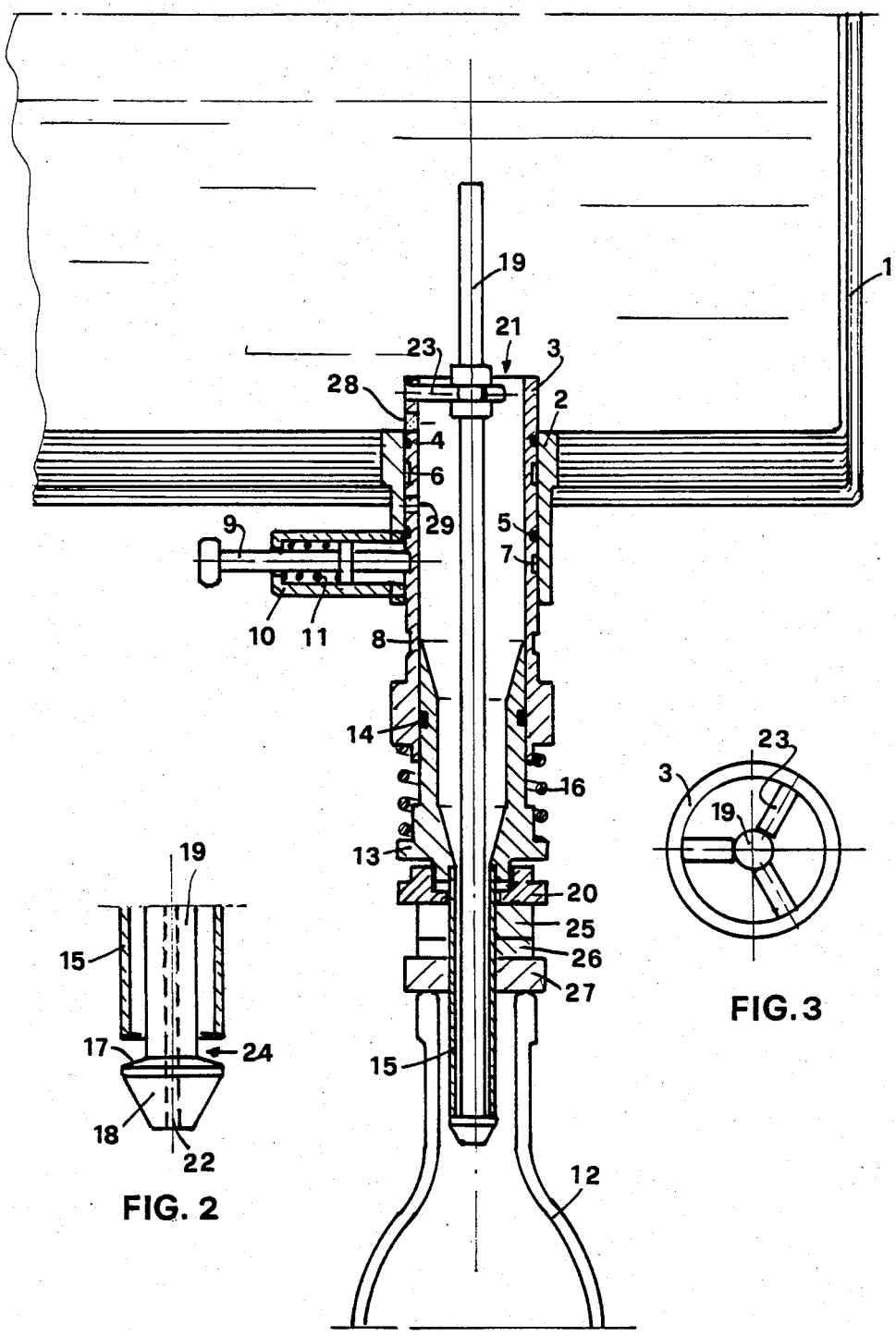
FIG. 1 is a cross-section of the tap being the object of the invention.
FIG. 2 is an enlarged cross-section of the terminal part of the open tap.
FIG. 3 shows a top view of the terminal part of the tap.

With reference to FIG. 1, tank 1 of the filling machine, which is not represented in the figure, presents a plurality of taps, one of which is represented in a cross-section.

Said tap includes a cylindrical sleeve 2 fixed to the bottom of the tank, for instance by means of screwing.

Said sleeve 2 is also equipped with a gasket, not being represented, which insures hydraulic tightness. A cylindrical cursor 3 is connected to sleeve 2 by means of a sliding coupling.

The hydraulic tightness of said coupling is guaranteed by a series of elastic circular rings, preferably made of rubber and marked with 4 and 5, arranged on the external cylindrical surface of cursor 3 and being in touch with the internal cylindrical surface of sleeve 2. Cursor 3 also has a series of annular cylindrical throats, as can be seen in 6, 7 and 8, and in one of them blocking pin 9 will be inserted. Said pin is guided inside a cylindrical shaft 10, being arranged horizontally and screwed at the spot corresponding to the lowest area of the external surface of said shaft. A spring 11, positioned between pin 9 and shaft 10 keeps the pin constantly leaning against the wall of the cursor.

Figure 4:
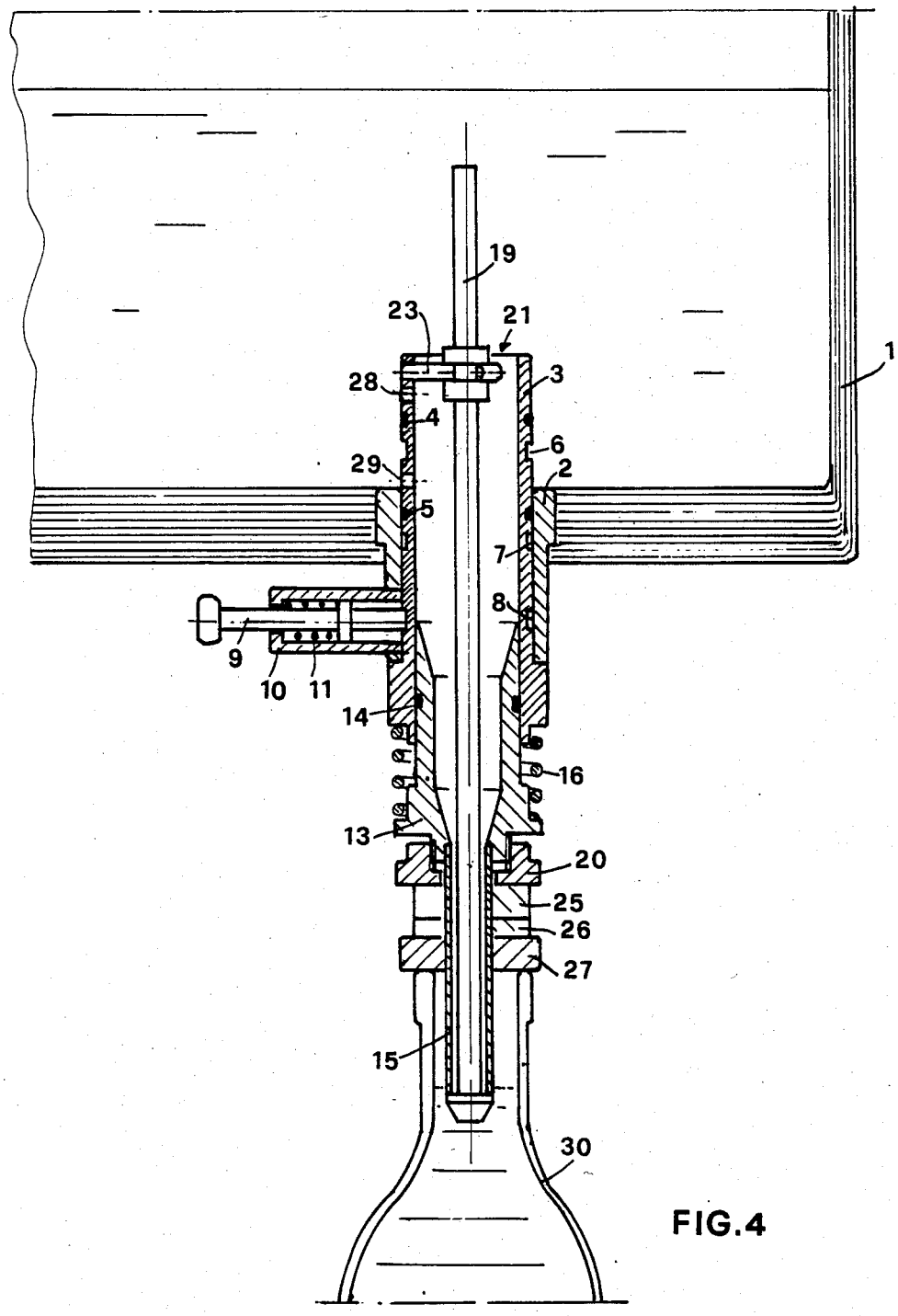
FIG. 4 is another cross-section of the tap with the cursor displaced upwards.

In order to change the cursor from one position to another, for instance, in order to change it from the position represented in FIG. 1 to the one represented in FIG. 4, it is enough to pull manually pin 9 toward the outside and to push the cursor upwards.

This type of adjustment is necessary when containers having different heights, bottles for instance, need to be filled. In the case of FIG. 1, bottle 12 is lower than bottle 30 of FIG. 4 in relation to the tank, therefore, in FIG. 1, cursor 3 is positioned with the pin inserted in the cylindrical throat 7. In FIG. 4 the pin is inserted in the cylindrical throat 8. In this case the seal is guaranteed by gasket 5, since gasket 4 is already outside of cursor 3. Cursor 3 houses in its lower terminal part another tube 13 being externally cylindrical and sliding inside the cursor and having a circular gasket 14. Said tube, which has an internal profile divided into sections of truncated cones, ends with a small pipe 15 fixed to the tube, which, when spring 16 is idle, rests on the tapered surface 17 of tip 18 of shaft 19 being coaxial with the little pipe and therefore also coaxial with cursor 3.

In fact, when the turning platform carrying the containers to be filled pushes the containers upward, tube 13 also moves upwards as a consequence and it drags upwards the small pipe 15 which is attached to it, thereby leaving an annular space 24 open, as can be seen in FIG. 2. The liquid descends through this open space while entering into cursor 3 through opening 21.

The air contained in bottle 12 exits through hole 22 which runs along the entire shaft 19. Said shaft is held straight by spacing collar 23, which is also visible in FIG. 3, and when the liquid in the bottle reaches the pre-determined level corresponding to the height of tap 18, the flow of liquid from the annular space 24 stops, because the liquid contained in the bottle shuts opening 22 for the air exhaust.

In order to adjust the level of the liquid contained in the bottle or in any other form of container, it is enough to vary the depth of penetration of the small pipe 15 in the container. For this reason one or more spacing rings 25, 26 as well as a washer 27 made of elastic material, such as rubber, are placed under collar 20; said washer 27 insuring the air tightness, in order to obtain the predetermined level. A further, finer adjustment is obtained by adjusting the tightening of threaded collar 20.

Finally, in order to allow the complete drainage of tank 1 after completion of the filling process, no matter what the position of cursor 3 of the tap is, said cursor 3 is complete with suitable openings for the drainage of the liquid, which are located in relation to the bottom of the tank for each position taken by the cursor. So, in FIG. 1, when the cursor protrudes outside of the tank, it is opening 28 which allows the drainage of the tank, while, when the cursor holds the position illustrated in FIG. 4, it is opening 29 which insures the drainage.

Naturally, the telescopic tap now being described can undergo some modifications during its manufacture, for instance the number and the shape of the impressions which hold the telescopic cursor 3 in a certain position, can be varied, and as a consequence the number of sealing rings, as well as the blocking system of the pin directly on the tank, rather than on the tap sleeve, can also vary; all these and other modifications still remaining within the scope of the invention expressed in the following claims.

I claim:

1. A tap for use with a tank of an automatic liquid-filling machine useable to fill containers having openings in the top surfaces thereof, said tap including means for fastening said tap to the bottom of the tank and comprising:

a cylindrical sleeve;

means for fixing said cylindrical sleeve to the tank;

a cylindrical cursor slideably housed in said cylindrical sleeve, said cylindrical cursor having an opening therethrough to facilitate passage of liquid therethrough;

a tube slideably housed in said cylindrical cursor and including a lower pipe portion sized so as to be insertable into the openings of said containers;

a tubular central vent shaft extending through said tube;

a collar mounted to said tube and providing a liquid-tight seal when engaged against a said opening of a said container;

said tube being displaced by engagement of said collar against the top surface of a said container to supply fluid to said container through said tube; and means for adjusting the position of said cylindrical cursor within said cylindrical sleeve so as to facilitate adjustment for containers of varying height, said means for adjusting including, a plurality of impressions formed in said cylindrical cursor at positions spaced along a longitudinal axis of said cylindrical cursor, and a locking device selectively engaging one of said plurality of impressions to block said cylindrical cursor at a desired position within said cylindrical sleeve.

2. The tap of claim 1 wherein said locking device comprises:

a pin horizontally arranged with respect to the longitudinal axis of said cylindrical cursor;

a cylindrical collar slideably supporting said pin and being fastened at one end thereof to said cylindrical sleeve; and a spring retained within said cylindrical collar and holding said pin against the external surface of said cursor, said pin engaging one of said impressions to block said cylindrical cursor.

3. The tap of claim 1 wherein said impressions are annular throats.

4. The tap of claim 1 further comprising a plurality of annular sealing rings formed of a resilient material interposed between said cylindrical sleeve and cylindrical cursor to provide a liquid tight seal therebetween.

5. The tap of claim 1 wherein said collar includes spacing rings disposed between a sealing surface of said collar and said tube for adjusting the amount of insertion of said lower pipe portion thereof into said container to adjust the level of liquid provided therein.

6. The tap of claim 5 wherein said collar is mounted to said tube with adjustment threads to provide fine adjustment of said liquid level.

7. The tap of claim 1 wherein said cursor includes at least one drain opening associated with each position at which said cylindrical cursor may be adjusted, each said drain opening communicating with the bottom of said tank to facilitate complete drainage thereof.

* * * * *